US009341068B2

(12) United States Patent
Nagano et al.

(10) Patent No.: US 9,341,068 B2
(45) Date of Patent: May 17, 2016

(54) BLADE

(75) Inventors: Kota Nagano, Hitachinaka (JP); Kunio Asai, Hitachi (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 820 days.

(21) Appl. No.: 13/589,233

(22) Filed: Aug. 20, 2012

(65) Prior Publication Data

US 2013/0084188 A1 Apr. 4, 2013

(30) Foreign Application Priority Data

Sep. 29, 2011 (JP) ..... 2011-213682

(51) Int. Cl.
*F01D 5/30* (2006.01)

(52) U.S. Cl.
CPC ..... *F01D 5/30* (2013.01); *F05D 2260/941* (2013.01)

(58) Field of Classification Search
CPC ..... F01D 5/30; F01D 5/3007
See application file for complete search history.

(56) References Cited

U.S. PATENT DOCUMENTS 6,033,185 A * 3/2000 Lammas et al. ..... 416/193 A
6,267,558 B1 * 7/2001 Dingwell et al. ..... 416/219 R
2008/0063529 A1 3/2008 Miller et al.

FOREIGN PATENT DOCUMENTS

JP 2008-69781 A 3/2008

* cited by examiner

*Primary Examiner* — Nathaniel Wiehe
*Assistant Examiner* — Cameron Corday
(74) *Attorney, Agent, or Firm* — Crowell & Moring LLP

(57) ABSTRACT

A blade avoids fretting damage while reducing stress occurring at the neck portion caused by a stress relief groove. The blade is disposed on an outer periphery of a rotor, and includes a blade portion, a dovetail portion for holding the blade on the rotor, a platform portion that connects the dovetail portion and the blade portion, and a stress relief groove that connects a side surface of the platform portion and a blade load bearing surface of the dovetail portion. The dovetail portion has a width that increases toward its bottom side within a range from a connection point between the side surface of the platform portion and the stress relief groove to a connection point between the dovetail portion and the stress relief groove.

5 Claims, 3 Drawing Sheets

BLADE

BACKGROUND OF THE INVENTION

1. Field of the Invention

The present invention relates to an embedding structure for a blade mounted in a rotating machine.

2. Description of the Related Art

In general, gas turbines incorporate a compressor for feeding compressed air to a combustor. The compressor includes a compressor rotor disposed thereinside, the rotor rotating about a central axis of the gas turbine. The compressor further includes a compressor blade embedded in a compressor disk fixed to the rotor.

The blade of a gas turbine compressor in operation undergoes a centrifugal force produced from weight of the blade itself and a large pressure load on a high pressure side. An exciting force arising from irregular pressure variations that occur during starting may therefore cause a vibrational stress to act on a blade dovetail portion, so that the blade dovetail portion may be damaged through fatigue.

Conventionally, an entire blade load bearing surface of the blade dovetail bears load of the foregoing types. A high stress, however, occurs at an end portion of contact between the blade load bearing surface and a rotor load bearing surface of the rotor. In addition to the high stress occurring, the point of contact develops fretting damage caused by wear, resulting at times in reduced reliability in fatigue strength.

JP-2008-69781-A (FIGS. 3 and 5) discloses a technique for avoiding reduction in the fatigue strength reliability by making an undercut (a stress relief groove) that includes three parts of a large radius portion, a small radius portion, and a straight line portion at an intersection portion between a neck portion and a pressure surface.

SUMMARY OF THE INVENTION

Even more enhanced reliability can, however, be achieved in a stress relief groove structure by identifying size, shape, and position of an arc thereof. With the blade disclosed in JP-2008-69781-A, in particular, the stress relief groove is formed such that a width (a cross-sectional area) of the neck portion decreases, which can result in increased stress concentration on that portion. In actual machines, therefore, a need exists for applying a stress relief groove structure that achieves even greater reliability, while avoiding fretting damage.

It is therefore an object of the present invention to provide a blade that can avoid fretting damage, while minimizing stress occurring at a neck portion from a stress relief groove.

To achieve the foregoing object, an aspect of the present invention provides a blade disposed on an outer periphery of a rotor. The blade includes: a blade portion; a dovetail portion for holding the blade portion in the rotor; a platform portion that connects the dovetail portion and the blade portion; and a stress relief groove disposed only in a range outside in a widthwise direction of the platform portion relative to a side surface of the platform portion, on a bottom side of the dovetail portion relative to an intersection point between the side surface of the platform portion and a blade load bearing surface of the dovetail portion. In this blade, the dovetail portion has a width that increases toward the bottom side thereof within a range from a connection point between the side surface of the platform portion and the stress relief groove to a connection point between the dovetail portion and the stress relief groove.

Preferably, the stress relief groove is disposed only in the range outside in a width direction of the platform portion relative to the side surface of the platform portion, on the bottom side of the dovetail portion relative to the intersection point between the side surface of the platform portion and the blade load bearing surface of the dovetail portion.

The present invention can provide a blade that avoids fretting damage, while reducing stress occurring at the neck portion as caused by the stress relief groove.

BRIEF DESCRIPTION OF THE DRAWINGS

The present invention will be described hereinafter with reference to the accompanying drawings.

DESCRIPTION OF THE PREFERRED EMBODIMENTS

Figure 2:
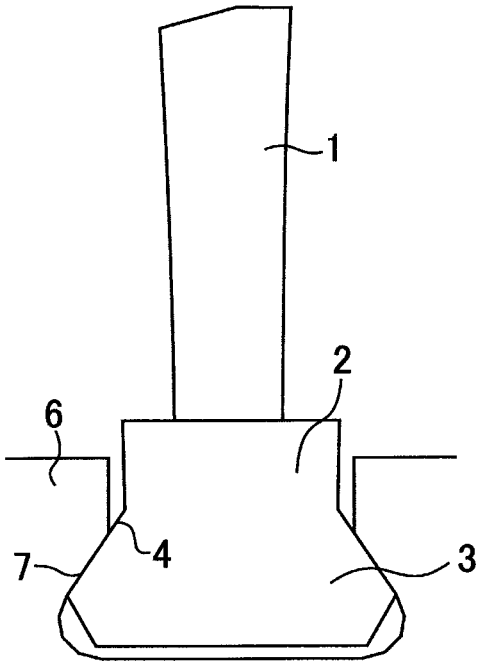
FIG. 2 is a diagram illustrating a common blade fit structure.

A common blade fit structure that serves as a comparative example of the present invention will be described below using a gas turbine compressor as an example and referring to FIGS. 2 and 3.

A blade of a gas turbine compressor broadly includes a blade portion 1, a platform portion 2 on which the blade portion 1 is mounted, and a dovetail portion 3 for inserting the blade into a groove in a rotor 6. The gas turbine compressor blade in operation undergoes a centrifugal force produced from weight of the blade itself and a large pressure load on a high pressure side. An exciting force arising from irregular pressure variations that occur during starting may therefore cause a vibrational stress to act on the blade dovetail portion, so that the blade dovetail portion may be damaged through fatigue. In general, an entire blade load bearing surface 4 of the dovetail portion 3 bears load of the foregoing types.

Figure 3:
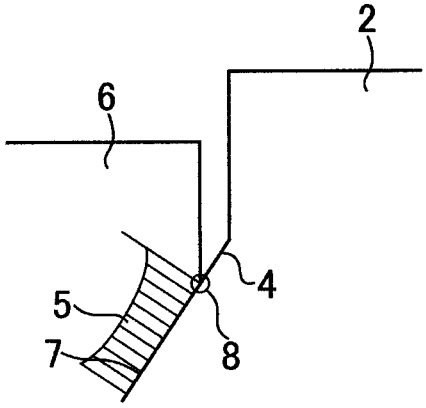
FIG. 3 is a diagram illustrating a stress distribution in the blade shown in FIG. 2.

As is known from a blade load bearing surface-equivalent stress distribution 5 shown in FIG. 3, however, a high stress is produced at a contact end portion 8 between the blade load bearing surface 4 and a rotor load bearing surface 7 of the rotor 6. In addition to the high stress occurring, the contact end portion 8 develops fretting damage caused by wear, resulting at times in reduced reliability in fatigue strength.

In contrast, as disclosed in JP-2008-69781-A, a known structure avoids the fretting damage by making the stress relief groove in the neck portion (platform portion) that is a connection between the blade portion 1 and the dovetail portion 3. If the stress relief groove structure entails a decreasing width of the neck portion, however, stress concentration may result.

Preferred embodiments of the present invention to solve the foregoing problem will now be described below with reference to the accompanying drawings.

First Embodiment

Figure 1:
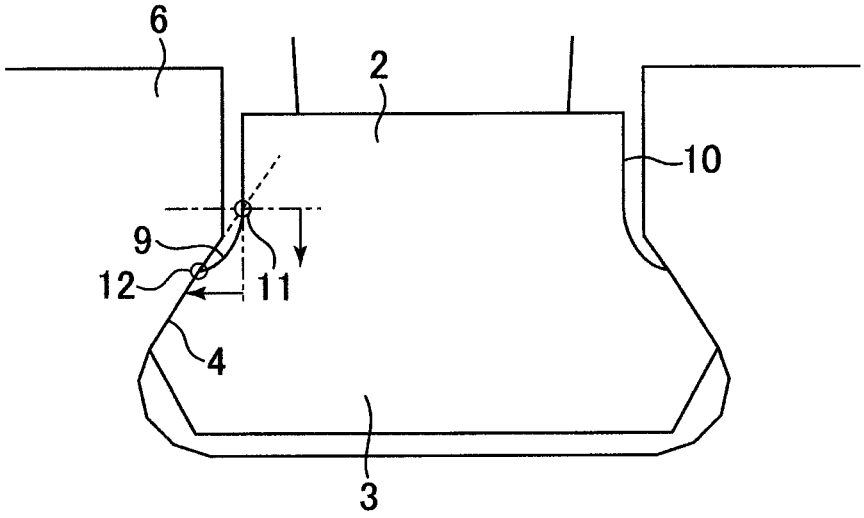
FIG. 1 is a diagram illustrating in detail an embedding portion of a blade in a rotating machine according to a preferred embodiment of the present invention.

FIG. 1 is a diagram illustrating a turbine blade groove structure that represents most features of the present invention as a first embodiment of the present invention. Referring to FIG. 1, the structure has a stress relief groove 9 disposed at a fit portion between a blade embedding portion formed in the rotor 6 and the dovetail portion 3. More specifically, the stress relief groove 9 is formed on an inner peripheral side of an intersection point 11 between a side surface 10 of the platform portion 2 and the blade load bearing surface 4 and on the side of the blade load bearing surface 4.

The stress relief groove 9 will be described in detail below. The stress relief groove 9 is formed at a portion that connects the side surface 10 of the platform portion 2 and the blade load bearing surface 4 of the dovetail portion 3. The stress relief groove 9 is formed such that any local stress concentration does not occur (no portions of the member have a narrow width). Specifically, the dovetail portion 3 has a width that increases toward a bottom side thereof (downward in FIG. 1) within a range from the connection point (intersection point) 11 between the side surface 10 of the platform portion 2 and the stress relief groove 9 to a connection point 12 between the dovetail portion 3 and the stress relief groove 9. Even more specifically, the stress relief groove 9 is formed only in a range outside in a widthwise direction of the platform portion 2 relative to the side surface 10 of the platform portion 2, on the bottom side of the intersection point 11 between the side surface 10 of the platform portion 2 and the blade load bearing surface 4 of the dovetail portion 3.

Figure 4:
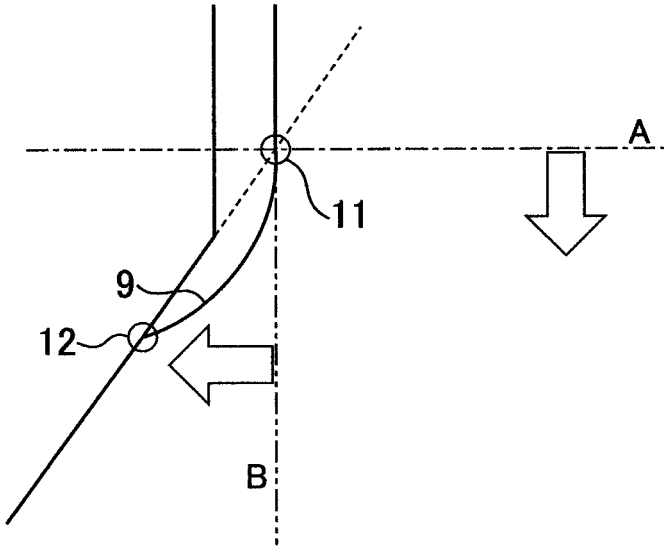
FIG. 4 is an enlarged view showing a stress relief groove in the blade shown in FIG. 1.

Effects of the first embodiment will be described below with reference to FIG. 4. The stress relief groove 9 according to the first embodiment is disposed on the inner peripheral side of a dash-single-dot line A and on the side of the rotor load bearing surface 7 relative to a dash-double-dot line B. This arrangement reduces stress produced at the contact end portion 8 and minimizes reduction in a fatigue life caused by fretting damage. In addition, the stress relief groove 9 does not extend to the platform portion 2 (the connection between the blade and the dovetail). This prevents stress involved in a decrease in an area of the connection between the blade and the dovetail from increasing relative to load produced from a centrifugal force.

It is noted that, in the arrangement disclosed in JP-2008-69781-A, the stress relief groove is formed at the portion at which the dovetail platform crosses the dovetail pressure surface. This arrangement results in a portion in the dovetail platform (or the dovetail) having a locally narrow width, which results in a portion having a locally narrow cross-sectional area. Specifically, stress concentrates in a local portion having a narrow cross-sectional area, resulting in degraded reliability.

In contrast, in the present invention, the stress relief groove is formed so as to eliminate any local portions having a narrow cross-sectional area. This allows fretting damage to be avoided, while reducing stress produced at the neck portion because of the stress relief groove.

Figure 5:
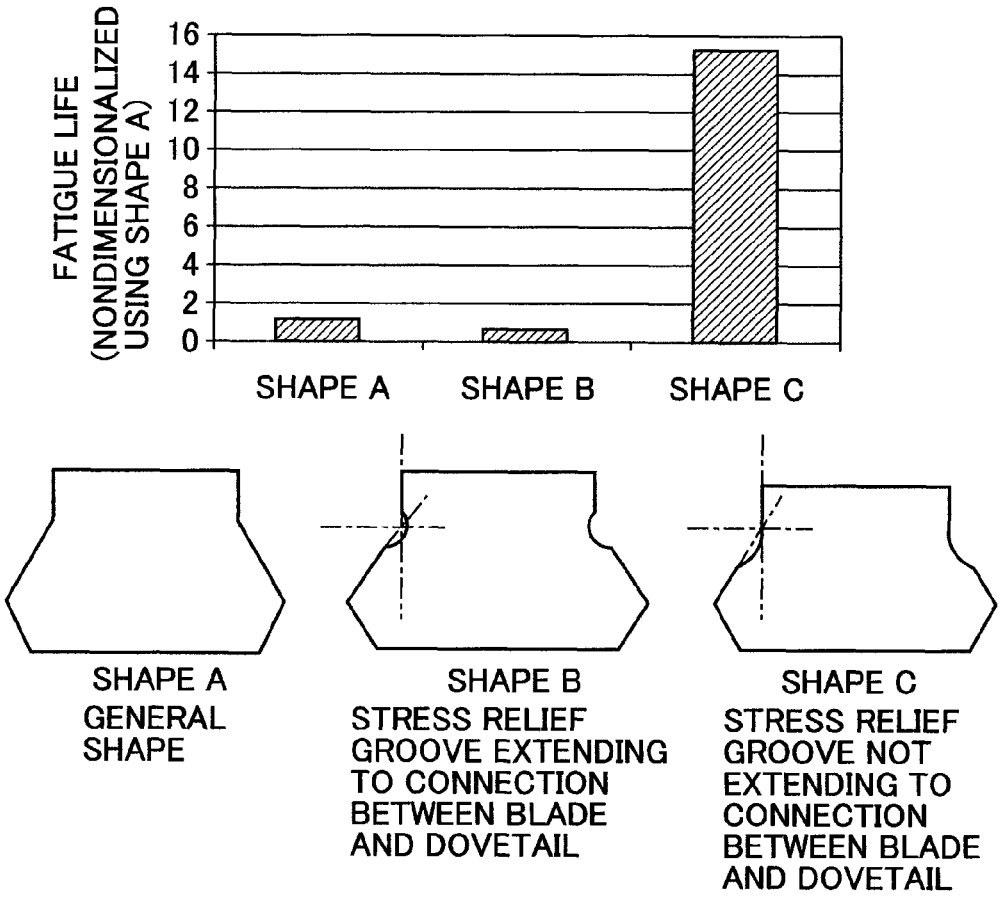
FIG. 5 is a graph showing results of a mock-up fatigue test.

FIG. 5 is a graph showing results of a mock-up fatigue test conducted on the first embodiment and the comparative example. Shape A represents the structure shown in FIGS. 2 and 3, shape B represents an arrangement having a stress relief groove formed such that the dovetail portion has a decreasing width, and shape C represents the structure according to the first embodiment of the present invention.

FIG. 5 shows the results of a mock-up fatigue test that simulates a condition in which an axial load occurs in the blade in each of the foregoing three cases. The test results are nondimensionalized using results of shape A.

The results show that the structure of shape C according to the first embodiment improves the fatigue life about ten times more than that of shapes A and B. With shape B in which the stress relief groove is formed such that the dovetail portion has a decreasing width, no difference is noted relative to the general shape of shape A and it is known that an examination of an appropriate shape is necessary, in addition to a measure for avoiding the fretting damage.

Second Embodiment

A second embodiment of the present invention will be described below. The second embodiment shares with the first embodiment the same arrangement of forming a stress relief groove so as to eliminate any local portion having a narrow cross-sectional area in a dovetail portion, but is characterized in that the stress relief groove has a single-arc curved surface. The single-arc shape simplifies the shape of the stress relief groove and facilitates machining.

Third Embodiment

As a third embodiment of the present invention, another shape of a stress relief groove 9 will be described below. Specifically, while being disposed at a position similar to that in the first and second embodiments, the stress relief groove 9 in the third embodiment is characterized in that the stress relief groove 9 is formed using two different parts; for example, arcs of two different sizes or an arc and a straight line. The stress relief groove 9 may be formed as in the third embodiment depending on, for example, restrictions in terms of manufacturing or shape.

Fourth Embodiment

Figure 6:
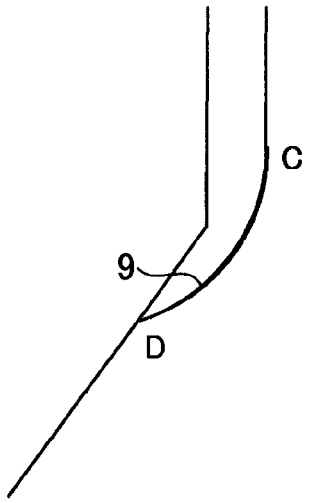
FIG. 6 is an exemplary diagram illustrating a stress relief groove to which compressive residual stress by shot peening is applied.

A fourth embodiment of the present invention is shown in FIG. 6. The fourth embodiment is characterized in that a stress relief groove surface C-D is subject to shot peening or water jet peening to thereby give compressive residual stress. Points C and D in FIG. 6 correspond to the intersection point 11 between the side surface 10 of the platform portion 2 and the blade load bearing surface 4 and the connection point 12 between the dovetail portion 3 and the stress relief groove 9. This is intended to avoid fretting and allows fatigue strength reliability of a stress concentration portion produced in a radius bottom of the stress relief groove thus formed to be improved.

It is noted that the shot peening or the water jet peening may be applied to the stress relief groove 9 formed using a single arc, and the two different parts, for example, arcs of two different sizes or an arc and a straight line, as described for the second and third embodiments.

As another method for improving the fatigue strength reliability of the stress concentration portion produced in the radius bottom of the stress relief groove, use of a friction agitation process for the stress relief groove portion is also effective. The friction agitation process involves inserting a tool protrusion rotating at high speed into a material and moving the tool protrusion in parallel, thereby refining crystals of the material and thus improving fatigue strength. In this case, the effect of improving the fatigue strength reliability can be achieved regardless of whether the friction agitation process is performed after the stress relief groove is formed or the friction agitation process is performed in advance on the position at which the stress relief groove is to be later formed.

Fifth Embodiment

A fifth embodiment of the present invention is characterized in that a stress relief groove is formed through shot peening. In forming the stress relief groove, a projection material offering good machinability, such as steel grit, is to be used. Alternatively, a pressure and a projection material that allow a stress relief groove to be formed are to be selected, the stress relief groove being such that an end portion of a rotor load bearing surface does not contact a blade load bearing surface.

It is to be noted that the present invention can be applied to avoidance of fretting damage on a contact end in a similar structure in a steam turbine or other rotating machine, in addition to the gas turbine blade groove structure.

What is claimed is:

1. A blade disposed on an outer periphery of a rotor, comprising:

a blade portion;

a dovetail portion for holding the blade on the rotor;

a platform portion that connects the dovetail portion and the blade portion; and a stress relief groove that connects a side surface of the platform portion and a blade load bearing surface of the dovetail portion, the stress relief groove disposed only in a range outside in a widthwise direction of the platform portion relative to the side surface of the platform portion, on a bottom side of the dovetail portion relative to an intersection point between the side surface of the platform portion and the stress relief groove, wherein the dovetail portion has a width that increases toward the bottom side thereof within a range from a connection point between the side surface of the platform portion and the stress relief groove to a connection point between the dovetail portion and the stress relief groove.

2. The blade according to claim 1, wherein the stress relief groove is formed using a single arc.

3. The blade according to claim 1, wherein the stress relief groove is formed using two different parts of a curved line.

4. The blade according to claim 1, wherein compressive residual stress by shot peening is given to a surface of the stress relief groove.

5. A rotating machine including a blade disposed on an outer periphery of a rotor, the blade comprising:

a dovetail portion for holding the blade on the rotor;

a platform portion that connects the dovetail portion and the blade; and a stress relief groove that connects a side surface of the platform portion and a blade load bearing surface of the dovetail portion, the stress relief groove disposed only in a range outside in a widthwise direction of the platform portion relative to the side surface of the platform portion, on a bottom side of the dovetail portion relative to an intersection point between the side surface of the platform portion and the stress relief groove, wherein the dovetail portion has a width that increases toward a bottom side thereof within a range from a connection point between the side surface of the platform portion and the stress relief groove to a connection point between the dovetail portion and the stress relief groove.

* * * * *